US007147113B2

(12) United States Patent
Obstfeld et al.

(10) Patent No.: US 7,147,113 B2
(45) Date of Patent: Dec. 12, 2006

(54) DISPLAY SYSTEM AND UNIT FOR MERCHANDISING EYEWEAR

(75) Inventors: Ian Jeffrey Obstfeld, Paradise Valley, AZ (US); Dean C. Bretz, Brea, CA (US); Thomas V. DiGiorgio, Newport Coast, CA (US)

(73) Assignee: Sunglass Designs, Inc., Scottsdale, AZ (US)

( * ) Notice: Subject to any disclaimer, the term of this patent is extended or adjusted under 35 U.S.C. 154(b) by 18 days.

(21) Appl. No.: 10/648,128

(22) Filed: Aug. 26, 2003

(65) Prior Publication Data

US 2005/0045572 A1 Mar. 3, 2005

(51) Int. Cl.
*A47F 7/02* (2006.01)

(52) U.S. Cl. ..... 211/85.1

(58) Field of Classification Search ..... 211/85.1, 211/128.1, 52, 81, 42; 248/902
See application file for complete search history.

(56) References Cited

U.S. PATENT DOCUMENTS 845,972 A * 3/1907 Gungst ..... 276/44
1,842,262 A * 1/1932 Gibson ..... 211/128.1
2,045,614 A * 6/1936 Reynolds ..... 211/72
2,532,600 A * 12/1950 Broersma ..... 211/55
D244,733 S 6/1977 Tammera
D245,956 S 10/1977 Dunchock
D250,438 S 12/1978 Loiacono
D250,560 S 12/1978 Gordon
D250,564 S 12/1978 Gordon
D251,047 S 2/1979 Winig
D251,162 S 2/1979 Winig
D251,344 S 3/1979 Winig
4,150,752 A * 4/1979 Breining et al. ..... 211/85.1
4,157,760 A 6/1979 Wilson
D252,360 S 7/1979 Dunchock
D252,481 S 7/1979 Gordon
D253,141 S 10/1979 Gordon
4,204,602 A 5/1980 Dunchock
D257,497 S 11/1980 Franklin et al.
D258,099 S 2/1981 Franklin et al.
D262,754 S 1/1982 Merl
D262,759 S 1/1982 Caldwell et al.
D264,025 S 4/1982 Franklin et al.
4,541,534 A 9/1985 Strauss
4,558,788 A 12/1985 Grothaus
D283,280 S 4/1986 Maynard et al.
4,586,619 A 5/1986 Eckert
4,614,272 A 9/1986 Shelton et al.
4,671,416 A 6/1987 Sorensen
4,718,561 A 1/1988 Eckert
4,779,938 A 10/1988 Johnston
4,787,520 A 11/1988 Pearson (Continued)

*Primary Examiner*—Sarah Purol
(74) *Attorney, Agent, or Firm*—Meschkow & Gresham, PLC

(57) ABSTRACT

A self-service display unit (100) for the merchandising of eyewear (102) is taught. The display unit (100) is made up of a horizontal bottom panel (120), a vertical left panel (150), a vertical right panel (160), and an oblique top panel (110) divided by a plurality of divider strips (170). The display unit (100) encompasses an interior space (103) configured to contain a plurality of inventory boxes (105). A display system (200) containing a plurality of the display units (100) between a left frame (202) and a right frame (204) is also taught. The display system (200) may face in a single direction or in two opposing directions. The display system (200) has a mirror (208) and signage (206) between the left frame (202) and the right frame (204).

20 Claims, 5 Drawing Sheets

U.S. PATENT DOCUMENTS

| | | | | |
|---|---|---|---|---|
| 4,890,745 | A | 1/1990 | Holden | |
| D314,292 | S | 2/1991 | Nyman | |
| 4,993,561 | A | 2/1991 | Stultz | |
| 5,016,759 | A | 5/1991 | Spamer | |
| 5,025,931 | A | 6/1991 | Berger | |
| 5,056,668 | A | 10/1991 | Berger | |
| D321,441 | S | 11/1991 | Khantzis | |
| D321,442 | S | 11/1991 | Khantzis | |
| D321,443 | S | 11/1991 | Khantzis | |
| D321,444 | S | 11/1991 | Khantzis | |
| D321,445 | S | 11/1991 | Khantzis | |
| D322,902 | S | 1/1992 | Khantzis | |
| 5,100,006 | A | 3/1992 | Forrester | |
| 5,101,986 | A | 4/1992 | Holztrager | |
| 5,257,703 | A | 11/1993 | Ascik et al. | |
| D345,097 | S | 3/1994 | Triangolo | |
| 5,316,252 | A | 5/1994 | Charnow et al. | |
| 5,337,903 | A | 8/1994 | Wolcovitch et al. | |
| 5,340,074 | A | 8/1994 | Porcaro et al. | |
| D358,319 | S | 5/1995 | Porcaro et al. | |
| D369,039 | S | 4/1996 | Guccione | |
| D374,366 | S | 10/1996 | Eldon, III et al. | |
| D374,786 | S | 10/1996 | Liebers | |
| 5,593,045 | A | 1/1997 | Eldon, III et al. | |
| D393,557 | S | 4/1998 | Guccione | |
| 5,775,018 | A | 7/1998 | Steinborn | |
| 5,819,957 | A | 10/1998 | Hahn | |
| D401,083 | S | 11/1998 | Woodward | |
| 5,853,090 | A | 12/1998 | Brozak, Jr. | |
| 5,861,941 | A | 1/1999 | Liebers et al. | |
| D406,714 | S | 3/1999 | Eldon, III et al. | |
| 6,073,782 | A | 6/2000 | Ascik | |
| D427,456 | S | 7/2000 | Guccione | |
| D429,417 | S | 8/2000 | Liebers et al. | |
| 6,302,369 | B1 | 10/2001 | Liebers et al. | |
| 6,378,707 | B1 * | 4/2002 | Taggert | 211/42 |
| 6,382,406 | B1 | 5/2002 | Corbasson | |
| 6,443,317 | B1 | 9/2002 | Brozak, Jr. | |
| D465,353 | S * | 11/2002 | Hessell et al. | D6/470 |

* cited by examiner

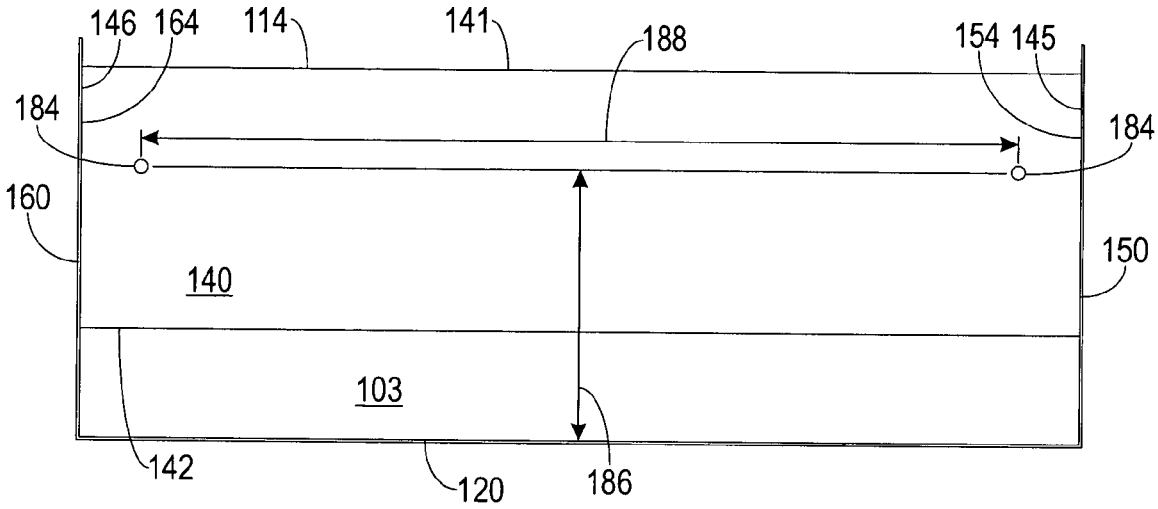
100 FIG. 6
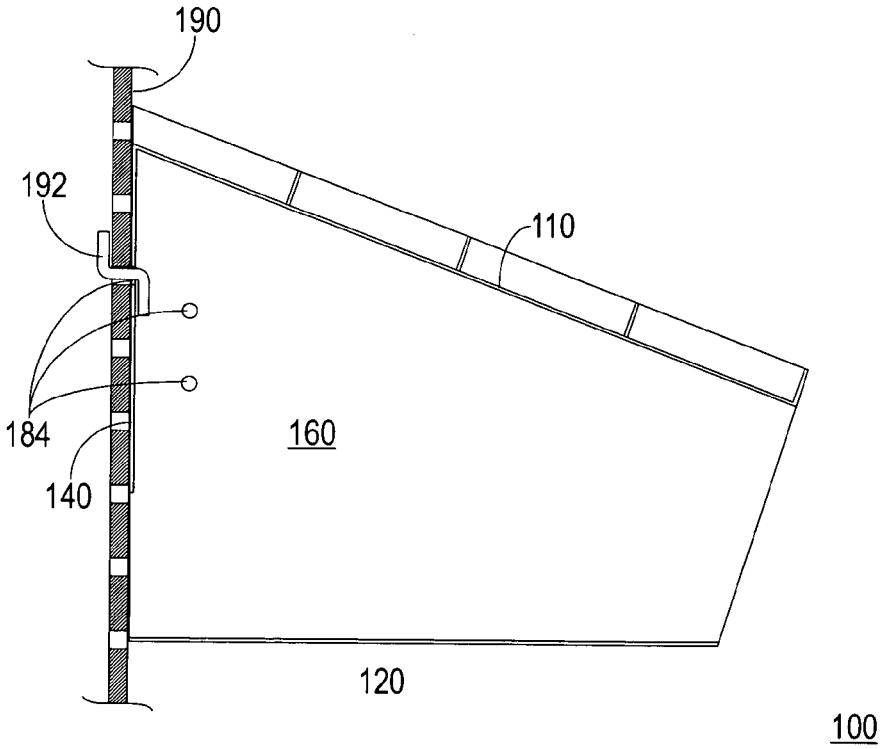
FIG. 7

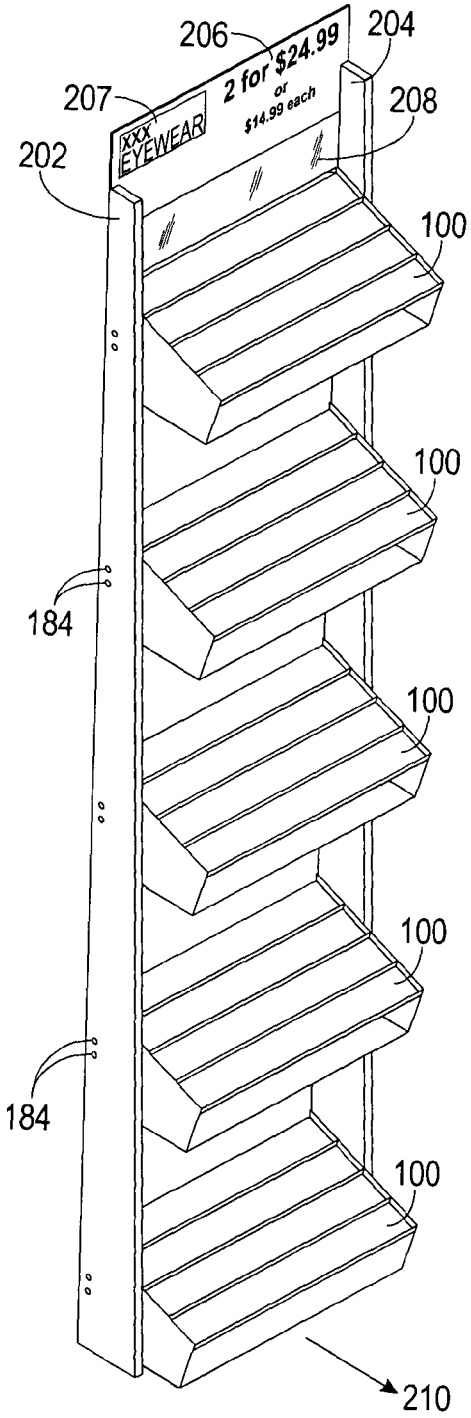
200 FIG. 8
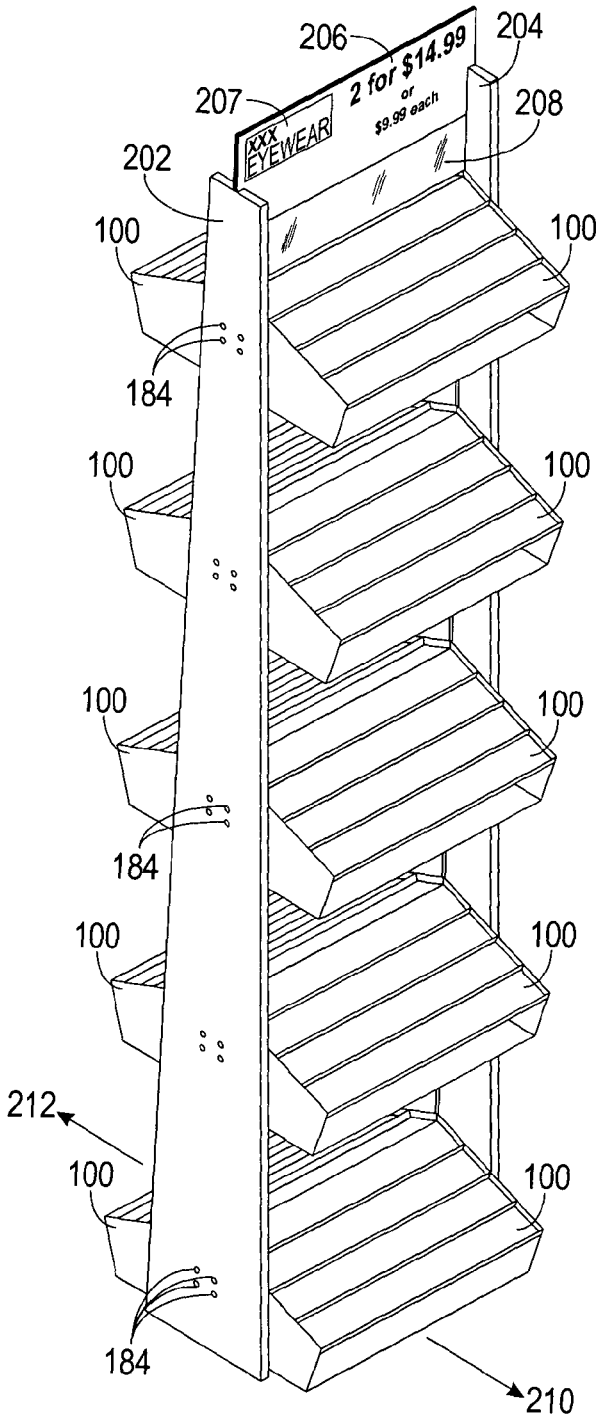
200 FIG. 9

DISPLAY SYSTEM AND UNIT FOR MERCHANDISING EYEWEAR

TECHNICAL FIELD OF THE INVENTION

The present invention relates to the field of merchandising displays. More specifically, the present invention relates to the field of merchandising displays for self-service eyewear selection.

BACKGROUND OF THE INVENTION

There are many displays for the self-service merchandising of eyewear (eyeglasses). But none are optimal for customer, retailer, distributor, and manufacturer needs.

One common type of self-service merchandising display uses the bridge and temples of each pair of eyeglasses to support those eyeglasses in a position approximating the position of the eyeglasses when worn on a human face. Such displays typically have holes through which the temples are inserted and a rod or similar support for the bridge. A display of this type requires that a customer exercise a certain care when removing and replacing the eyeglasses. Such care may not be exercised by a customer in a hurry. The lack of necessary care may potentially result in dropped eyewear, product damage, customer frustration, and a failure to purchase. Additionally, when a bridge-and-temple display is tall and used by a standing customer, those glasses on the lower levels are not displayed at an appropriate angle for viewing and critiquing. The customer is able to see only the tops of the frames.

Another type of self-service merchandising display has a substantially horizontal flat surface upon which the eyeglasses are displayed in a folded configuration. Such a display may fail to exhibit the eyeglasses in a position approximating the position of the eyeglasses when worn by a person standing or sitting. At best, the folded eyeglasses are left "staring up," as though worn by a person lying on his/her back. More often, the flat surface of the display may cause the eyeglasses to assume a back-tilting attitude in which the "lower" edges of the lenses are above the "upper" edges. Eyeglasses displayed in such an unnatural attitude may fail to catch the eye of a customer. This may in turn result in lost sales.

An alternative "flat-topped" display may have the flat display areas in steps. With such displays, the stepping brings the upper display areas under the bottoms of other display areas when the displays are mounted vertically. This greatly decreases the visibility of the upper-area eyeglasses on the lower displays.

Most self-service merchandising displays lack storage of additional inventory that is easily and efficiently accessed by the customer. That is, the customer normally has access only to those eyeglasses then on display. When all of a given type (style and/or strength) of eyeglasses is gone from the display, the customer is denied that type. This, too, may result in lost sales.

All self-service marketing displays occupy space. In a retail establishment, space is usually at a premium. This is especially true of newsstands, gift shops, boutiques, and similar establishments. A successful display should have a plurality of mounting options in order to accommodate a plurality of retail situations.

To be effective, a display must catch the eye of passersby, drawing them into a retail establishment. Once inside, the passersby become potential customers. The display must then be arranged to provide a pleasurable experience (i.e., one with maximum of accessibility and a minimum of frustration) in order to turn the potential customers into real customers and completed sales.

Secondarily, a display that successfully draws passersby into a retail establishment converts them into potential customers for other merchandise as well.

SUMMARY OF THE INVENTION

Accordingly, it is an advantage of the present invention that a display system and unit for merchandising eyewear is provided.

It is another advantage of the present invention that a display unit is provided that has a plurality of mounting options.

It is another advantage of the present invention that a display unit is provided that presents eyewear to a potential customer in an intuitive and easy to handle manner.

It is another advantage of the present invention that a display unit is provided that displays eyewear in a natural attitude.

It is another advantage of the present invention that a display unit is provided that provides customer-accessible back-up inventory.

The above and other advantages of the present invention are carried out in one form by a display unit for merchandising eyewear. The display unit is made up of a substantially horizontal bottom panel, left and right panels coupled to the bottom panel, and a top panel coupled between the left and right panels oblique to the bottom panel.

The above and other advantages of the present invention are carried out in one form by a display system for merchandising eyewear, The display system is made up of left and right frames, and a plurality of display units coupled between the left and right frames. Each of the display units is made up of a substantially horizontal bottom panel, left and right panels substantially perpendicularly coupled to the bottom panel, and a top panel obliquely coupled between the left and right panels.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

FIG. 6 shows a back view of a display unit demonstrating mounting holes in accordance with a preferred embodiment of the present invention;

FIG. 7 shows a cross-sectional side view of a display unit demonstrating attachment to a vertical surface in accordance with a preferred embodiment of the present invention;

FIG. 8 shows an isometric view of a single-faced display system in accordance with a preferred embodiment of the present invention; and FIG. 9 shows an isometric view of a double-faced display system in accordance with a preferred embodiment of the present invention.

DETAILED DESCRIPTION OF THE PREFERRED EMBODIMENTS

Figure 1:
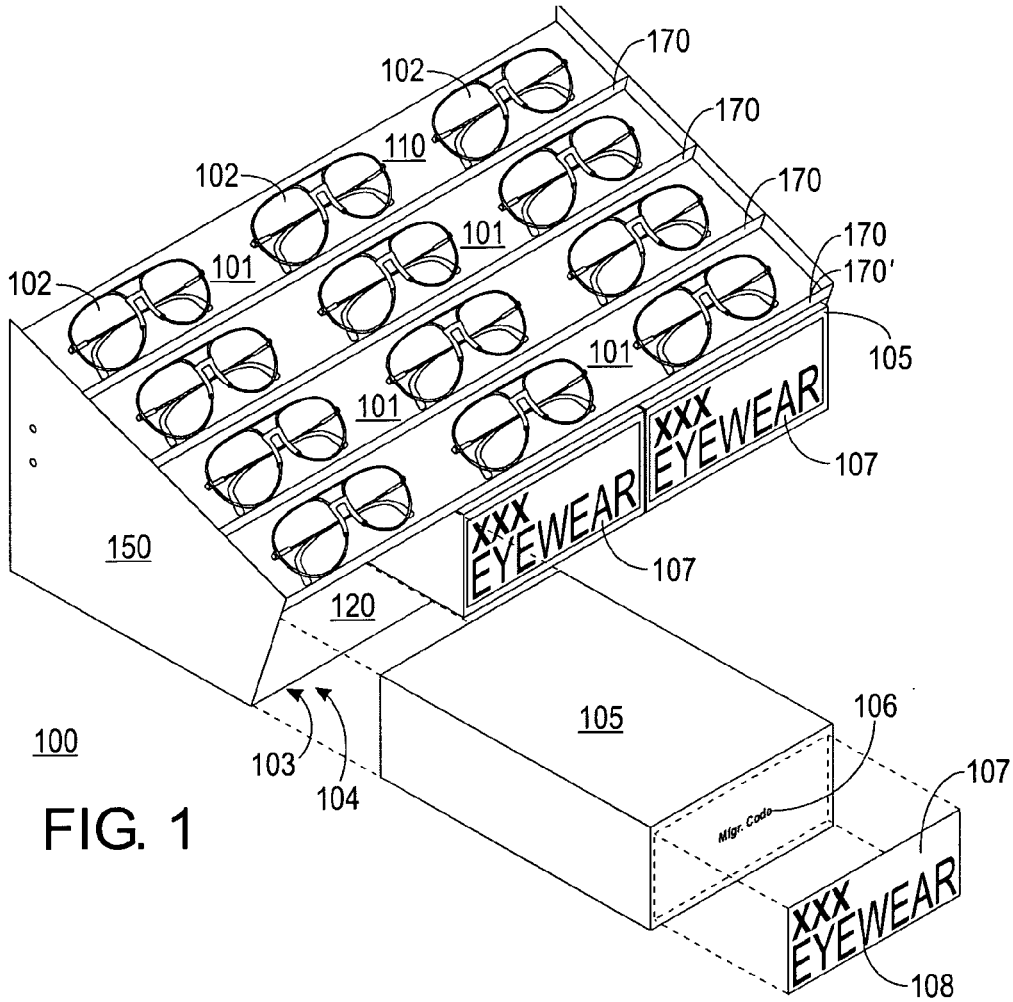
FIG. 1 shows an isometric front view of a display unit loaded with eyeglasses and inventory boxes in accordance with a preferred embodiment of the present invention.
Figure 2:
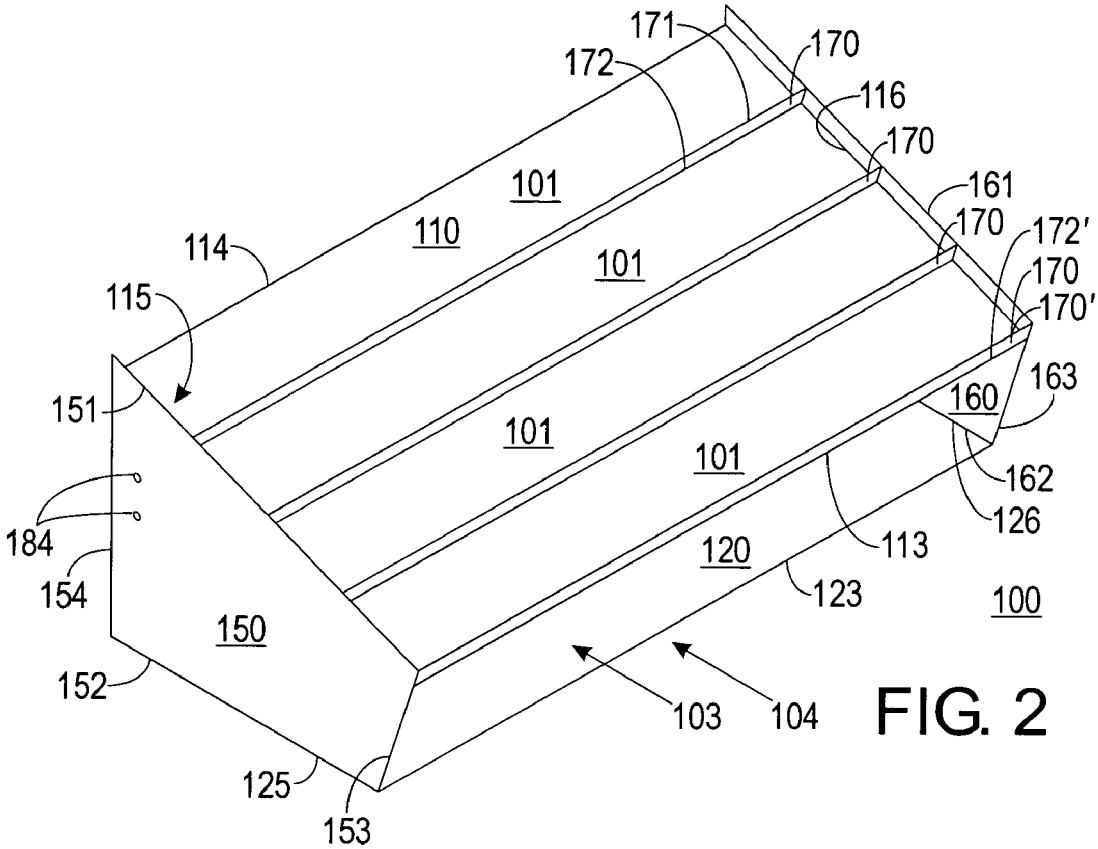
FIG. 2 shows an isometric front view of a display unit in accordance with a preferred embodiment of the present invention.
Figure 3:
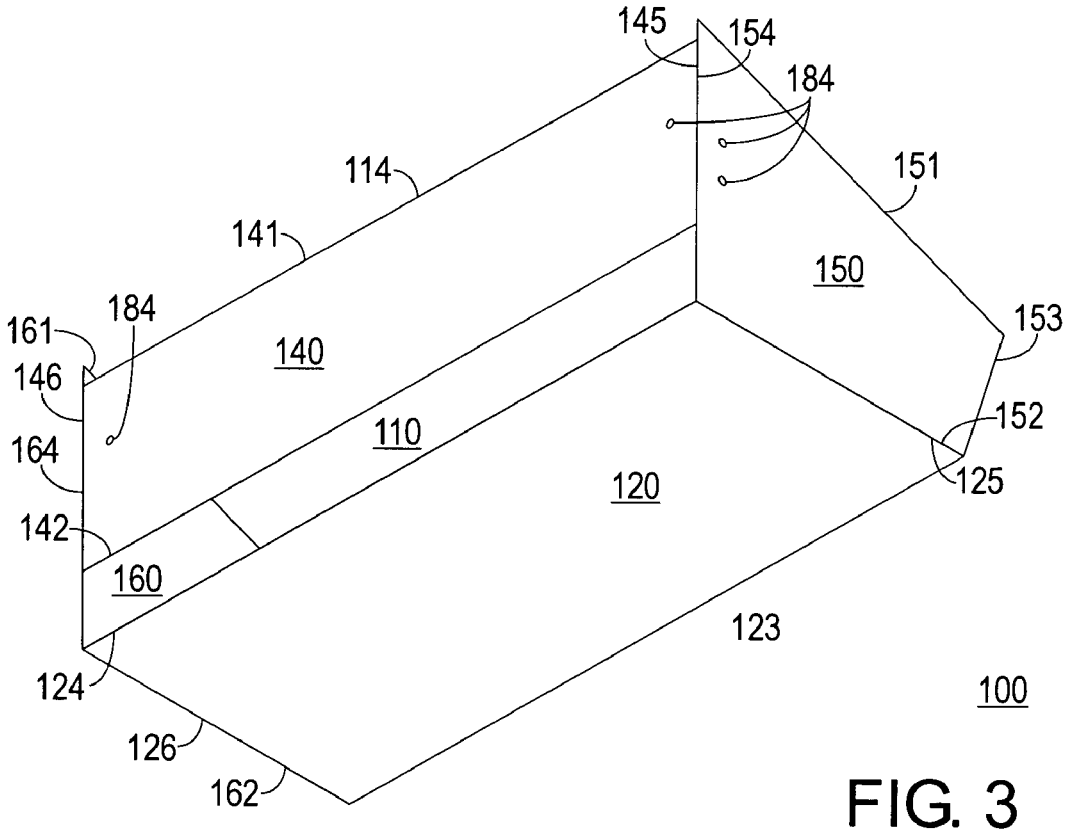
FIG. 3 shows an isometric back view of a display unit in accordance with a preferred embodiment of the present invention.
Figure 4:
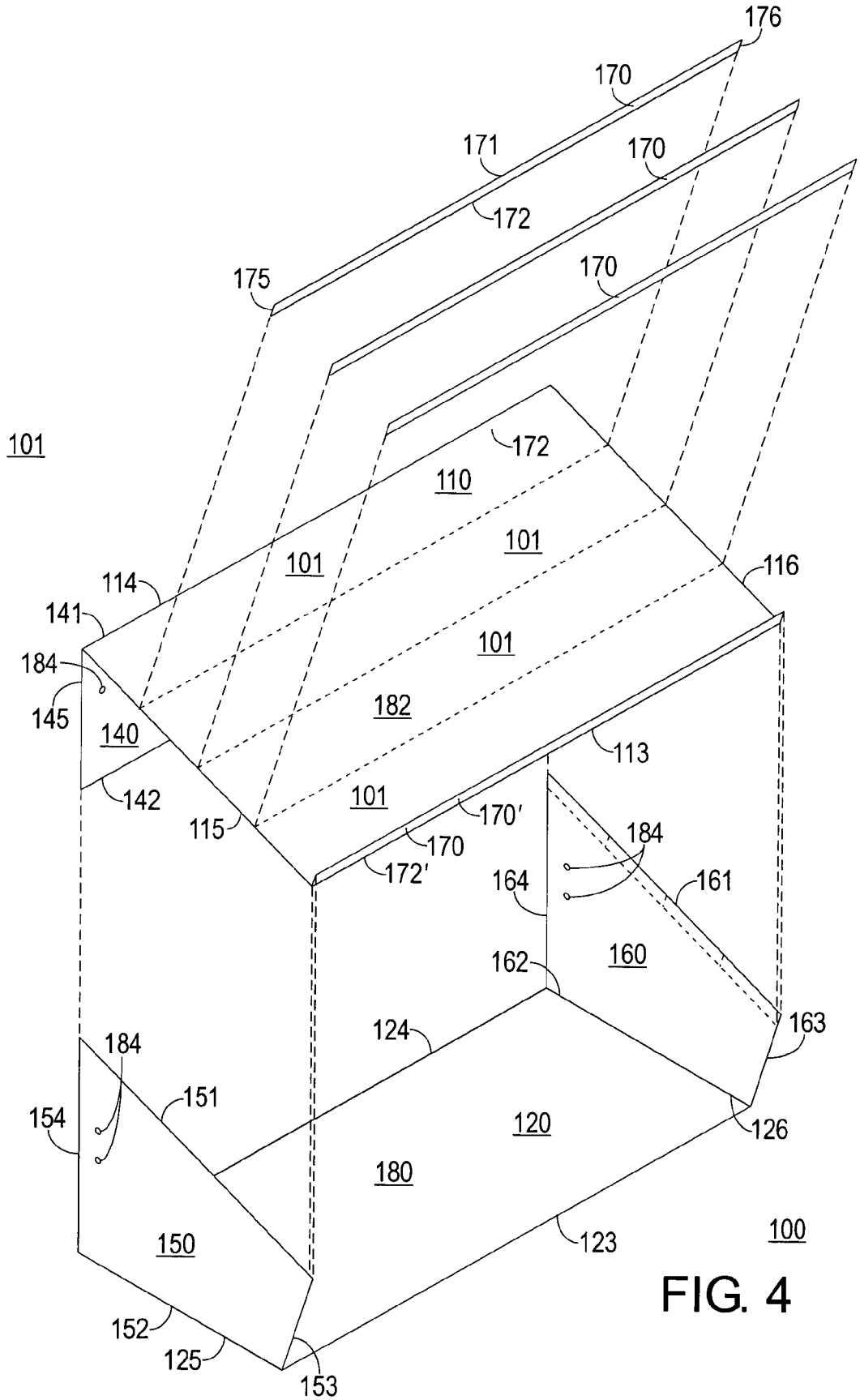
FIG. 4 shows an exploded isometric view of a display unit demonstrating the construction thereof in accordance with a preferred embodiment of the present invention.

FIG. 1 shows an isometric front view of a display unit 100 loaded with eyewear 102 and inventory boxes 105 in accordance with a preferred embodiment of the present invention. FIGS. 2 and 3 show isometric front (FIG. 2) and back (FIG. 3) views of display unit 100 in the preferred embodiment. FIG. 4 shows an exploded isometric view of display unit 100 demonstrating the construction thereof in accordance with a preferred embodiment. The following discussion refers to FIGS. 1, 2, 3, and 4.

Display unit 100 is configured to display eyewear 102 in a simple and pleasing manner. Eyewear 102 is displayed in an upright position with the temples folded. In addition, an inventory of additional eyewear (not shown) is contained in inventory boxes 105 also plainly displayed in display unit 100. This additional inventory is intended for customer access as a supplement to eyewear 102 openly displayed.

Throughout this discussion, the terms of orientation "top," "bottom," "front," "back," "left," and "right" are used. These terms, especially "front," "back," "left," and "right," are relative to an observer standing in front of and facing display unit 100 as depicted in the Figures. "Front" means closer to the observer, and "back" means farther from the observer. "Left" and "right" mean on the observer's left and right, respectively. In FIG. 1, the observer would be standing to the lower right and facing the upper left.

Display unit 100 is made up of a top panel 110, a base or bottom panel 120, a left panel 150, and a right panel 160. Each of panels 110, 120, 150, and 160 is substantially planar.

In the preferred embodiment, top panel 110 is substantially a rectangle having a front top-panel edge 113, a back top-panel edge 114, a left top-panel edge 115, and a right top-panel edge 116. Those skilled in the art will appreciate that top panel 110 may have a shape other than a rectangle without departing from the spirit of the present invention.

In the preferred embodiment, bottom panel 120 is substantially a rectangle having a front bottom-panel edge 123, a back bottom-panel edge 124, a left bottom-panel edge 125, and a right bottom-panel edge 126. Those skilled in the art will appreciate that bottom panel 120 may have a shape other than a rectangle without departing from the spirit of the present invention.

In the preferred embodiment, left panel 150 is substantially a right trapezium having a top left-panel edge 151, a bottom left-panel edge 152, a front left-panel edge 153, and a back left-panel edge 154 substantially perpendicular to bottom left-panel edge 152. Those skilled in the art will appreciate that left panel 150 may have a shape other than that of a right trapezium without departing from the spirit of the present invention.

In the preferred embodiment, right panel 160 is substantially a right trapezium having a top right-panel edge 161, a bottom right-panel edge 162, a front right-panel edge 163, and a back right-panel edge 164 substantially perpendicular to bottom right-panel edge 162. Desirably, right panel 160 is substantially identical to left panel 150, but this is not a requirement of the present invention. Those skilled in the art will appreciate that right panel 160 may have a shape other than that of a right trapezium without departing from the spirit of the present invention.

In the preferred embodiment, bottom panel 120 is substantially horizontal and provides a base for display unit 100. Left panel 150 is substantially perpendicularly joined to bottom panel 120 (i.e., is substantially vertical). Right panel 160 is substantially perpendicularly joined to bottom panel 120 substantially parallel to left panel 150. Top panel 110 is substantially perpendicularly joined to each of left and right panels 150 and 160 oblique to bottom panel 120.

In detail, left bottom-panel edge 125 is joined to bottom left-panel edge 152, rendering left panel 150 and bottom panel 120 substantially coterminous. Similarly, right bottom-panel edge 126 is joined to bottom right-panel edge 162, rendering right panel 160 and bottom panel 120 substantially coterminous.

Left top-panel edge 115 is joined to left panel 150 proximate and parallel to top left-panel edge 151. Right top-panel edge 116 is joined to right panel 160 proximate and parallel to top right-panel edge 161. Front and back top-panel edges 113 and 114 are parallel to bottom panel 120, with front top-panel edge 113 being closer to bottom panel 120 than back top-panel edge 114. Top panel 110 is therefore oblique to bottom panel 120. This gives display unit 100 the general shape of a right trapezial prism.

Top panel 110 is subdivided into display areas 101 by a plurality of divider strips 170. Each divider strip 170 is substantially a thin rectangular panel, having a top divider-strip edge 171, a bottom divider-strip edge 172, a left divider-strip edge or end 175, and a right divider-strip edge or end 176. Those skilled in the art will appreciate that divider strips 170 may have shapes other than rectangles without departing from the spirit of the present invention In the preferred embodiment, a first divider strip 170' is joined to top panel 110 so that first divider strip 170' is substantially perpendicular to top panel 110. A bottom first-divider-strip edge 172' is joined to or formed from front top-panel the edge. The remaining divider strips 170 are joined to top panel 110 so that each divider strip 170 is substantially perpendicular to top panel 110 and parallel to first divider strip 170', with bottom divider-strip edges 172 joined to top panel 110. Divider strips 170 are substantially equally spaced so as to divide top panel 110 into substantially equal display areas 101. In this manner, top panel 110 and dividers strips 170 are configured to support and display eyewear 102.

Top panel 110 is joined to left and right panels 150 and 160 so that left and right top-panel edges 115 and 116 are proximate top left-panel and right-panel edges 151 and 161. In the preferred embodiment, left top-panel edge 115 and left divider-strip edges 175 are coupled to left panel 150 so that each of top divider-strip edges 171 is substantially coincident with top left-panel edge 151. Similarly, right top-panel edge 116 and right divider-strip edges 176 are coupled to right panel 160 so that each of top divider-strip edges 171 is substantially coincident with top right-panel edge 161.

Top panel 110, with divider strips 170, is therefore joined to left and right panels 150 and 160 so that each of display areas 101 assumes the shape of a shallow inclined rectangular tray suitable for holding and displaying eyewear 102. Since top panel 110 is oblique and slopes downward towards the front, a divider strip 170 at back top-panel edge 114 is not needed.

Since top panel 110 is oblique, eyewear 102 in a display area 101 will tend to slide down top panel 110 to the divider strip 170 forming the lower-front limit of that particular display area 101. Also, since top panel 110 is oblique, display areas 101 present eyewear 102 in an intuitive and pleasing attitude over a wide vertical viewing angle.

For structural integrity, display unit 100 also has a back panel 140. In the preferred embodiment, back panel 140 is substantially a rectangle having a top back-panel edge 141, a bottom back-panel edge 142, a left back-panel edge 145, and a right back-panel edge 146. Those skilled in the art will appreciate that back panel 140 may have a shape other than a rectangle without departing from the spirit of the present invention.

One purpose of back panel 140 is to provide rigidity and strength to display unit 100. To accomplish this, back panel 140 is joined to top panel 110, left panel 150, and right panel 160. In the preferred embodiment, top back-panel edge 141 is joined to back top-panel edge 114, rendering back panel 140 and top panel 110 substantially coterminous. In addition, left back-panel edge 145 is joined to back left-panel edge 154, and right back-panel edge 146 is joined to back right-panel edge 164. This renders back panel 140 substantially perpendicular to bottom panel 120.

Desirably, bottom back-panel edge 142 is displaced from bottom panel 120. It is not necessary to join back and bottom panels 140 and 120, and to do so would increase materials and construction costs, and would form a closed back surface inside display unit 100 where dirt and debris may accumulate.

In the preferred embodiment, bottom left-panel edge 152 is joined to left bottom-panel edge 125, and right bottom-panel edge 126 is joined to bottom right-panel edge 162. This renders left panel 150, bottom panel 120, and right panel 160 coterminous. Because of this, left panel 150, bottom panel 120, and right panel 160 may be formed of a single piece 180 where the joined edges are formed by bending.

Similarly, bottom first-divider-strip edge 172' is joined to front top-panel edge 113, and back top-panel edge 114 is joined to top back-panel edge 141. This renders first divider strip 170', top panel 110, and back panel 140 coterminous. First divider strip 170', top panel 110, and back panel 140 may be formed of a single piece 182 where the joined edges are formed by bending.

By forming display unit 100 of two primary pieces 180 and 182, plus the remaining divider strips 170, a significant savings in materials and assembly costs may be realized.

Those skilled in the art will appreciate that the method of forming and assembling the components of display unit 100 described hereinbefore are exemplary only, and that other methods may be used without departing from the spirit of the present invention.

Display unit 100 may be made of sheet metal, acrylic or other rigid plastic, wood, or any other material chosen for utility and/or appearance. The choice of materials is irrelevant, and any desired materials may be chosen without departing from the spirit of the present invention. The components of display unit 100 may be joined in any manner suitable for the selected materials and known to those skilled in the art. This joining methodology includes but is not limited to the use of fasteners, welding, adhesives, etc.

Figure 5:
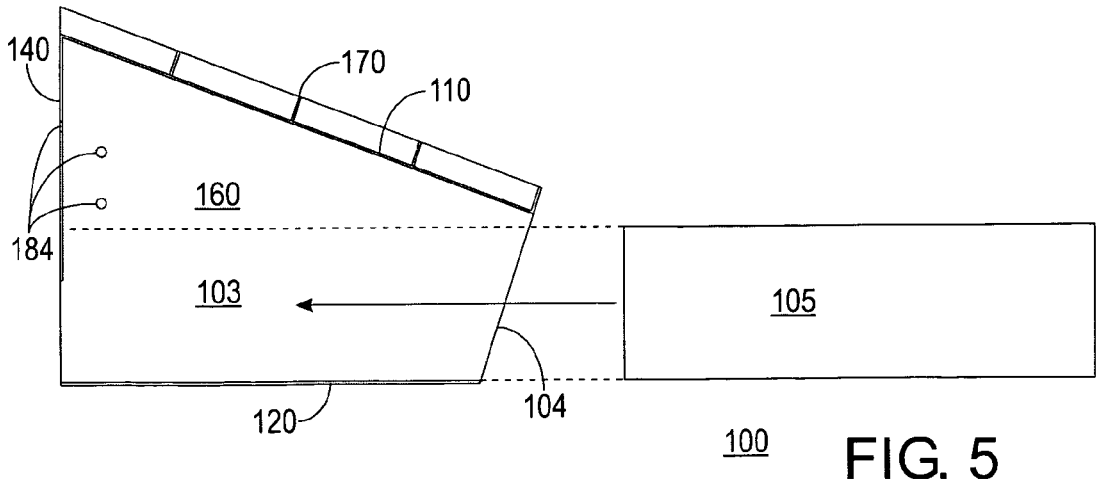
FIG. 5 shows a cross-sectional side view of a display unit demonstrating an interior space configured for inventory boxes in accordance with a preferred embodiment of the present invention.

FIG. 5 shows a cross-sectional side view of display unit 100 demonstrating an interior space 103 configured for inventory boxes 105 in accordance with a preferred embodiment of the present invention. The following discussion refers to FIGS. 1, 2, 3, and 5.

Display unit 100 lacks a front panel. Instead, there is a front opening 104 into interior space 103. Eyewear 102 typically comes in semi-standardized inventory boxes 105, with each inventory box 105 containing a number of eyewear of a given type, style, or power. Each inventory box 105 therefore contains an inventory of that given type, style, or power of eyewear 102. Top, bottom, back, left, and right panels 110, 120, 140, 150, and 160 encompass interior space 103. Interior space 103 is configured to house a plurality of inventory boxes 105. While not a requirement of the present invention, it is desirable that back panel 140 extend downward enough to prevent inventory boxes 105 from passing through interior space 103 and out the back of display unit 100.

Inventory boxes 105 are typically received bearing a manufacturer's code 106 or other designation. This manufacturer's code 106 seldom has significance to the retail store. In addition, manufacturer's code 106 may be a sticker, stamped mark, or even a hand-written mark lacking in visual appeal. Therefore, a label 107 may be used to cover manufacturer's code 106 and provide the desired visual appeal.

FIG. 6 shows a back view of display unit 100 demonstrating mounting holes 184 on back panel 140, and FIG. 7 shows a cross-sectional side view of display unit 100 demonstrating attachment to a vertical surface 190 in accordance with a preferred embodiment of the present invention. The following discussion refers to FIGS. 3, 4, 6, and 7.

Display unit 100 may be set upon a counter or other flat surface. In this case, feet (not shown) may be attached to bottom panel 120 to inhibit slipping on the counter. Such feet would also inhibit scratching of the counter when display unit 100 is moved.

Alternatively, display unit 100 may be hung from a substantially flat vertical surface 190, such as a slatwall, gridwall, or pegboard surface. To facilitate this, the preferred embodiment of display unit 100 incorporates mounting holes 184 in back panel 140. A first mounting hole 184 is located proximate left back-panel edge 145 and a second mounting hole 184 is located proximate right back-panel edge 146. Each of mounting holes 184 is a predetermined distance (height) 186 above bottom panel 120. This allows display unit 100 to be level when hung. Mounting holes 184 are separated by a separation distance 188. A separation distance 188 of an integral number of inches allows display unit 100 to be hung from a standard one-inch-on-center pegboard.

In FIG. 7, display unit is depicted hanging from a pegboard panel using standard "Z" clips 192. Those skilled in the art will appreciate that other mounting methods, including but not limited to screws, nails, or hooks, may be used without departing from the spirit of the present invention.

FIGS. 8 and 9 show isometric views of single-faced (FIG. 8) and double-faced (FIG. 9) display systems 200 in accordance with a preferred embodiment of the present invention. The following discussion refers to FIGS. 1, 2, 3, 8, and 9.

Display units 100 may be combined into a display system 200. Display system 200 contains at least one display unit 100 together with rigid left and right frames 202 and 204. Signage 206 and/or a mirror 208 may also be used.

In the preferred single-faced embodiment of FIG. 8, five display units 100 are positioned vertically between rigid left and right frames 202 and 204, along with a mirror 208 and signage 206. Being single-faced, display system 200 faces in a single given direction 210. Each display unit 100 also faces in this given direction.

Mounting holes 184 are located in left and right panels 150 and 160 of each display unit 100. These mounting holes 184 line up with a vertical line of mounting holes 184 in left and right frames 202 and 204. Frames 202 and 204 may be attached to display units 100 through mounting holes 184 using conventional bolts and nuts.

In the preferred embodiment, left and right frames 202 and 204 are shaped substantially as right trapezoids. This gives a pleasing and elegant appearance while simultaneously providing a maximum of stability and strength. Those skilled in the art will appreciate that left and right frames 202 and 204 may assume other shapes without departing from the spirit of the present invention.

Single-faced display system 200 of FIG. 8 may be mounted to a vertical surface or made free standing, as desired.

In the preferred double-faced embodiment of FIG. 9, ten display units 100 are positioned vertically between rigid left and right frames 202 and 204, along with a mirror 208 and signage 206. Being double-faced, display system 200 faces in a first given direction 210 and a second given direction 212 opposing first direction 210. Display units 100 are mounted back-to-back, so that one-half of display units 100 face in the first given direction 210 and one-half of display units 100 face in second given direction 212.

Mounting holes 184 in left and right panels 150 and 160 of each display unit 100 line up with and are attached to two vertical lines of mounting holes 184 in left and right frames 202 and 204.

In the preferred embodiment, left and right frames 202 and 204 of a double-faced display system 200 are shaped substantially as isosceles trapezoids, rather than the right trapezoids of the single-faced display system 200. Again, those skilled in the art will appreciate that left and right frames 202 and 204 may assume other shapes without departing from the spirit of the present invention.

Double-faced display system 200 of FIG. 9 desirably is free standing. To this end, display system may be fitted with feet, wheels, or a turntable (all not shown), as desired.

Signage 206 and colors of display system 200 are desirably configured to catch the eye of passersby. To this end, signage 206 is desirably located above the uppermost display unit 100. In this position, the eye is naturally led to display system 200 over other lower-level displays.

The use of oblique top panels 110 by display units 100 significantly increases the visibility of each pair of eyewear 102 in a vertically stacked display system 200. This increase in visibility allows display units 100 to be stacked more closely than would otherwise be commensurate with good marketing and display practices. This in turn increase the type, styles, and/or powers of eyewear 102 that may be display in a given area, thereby potentially increasing sales.

In addition, signage 206 desirably includes an indicium 207 of a brand name or other identification. Labels 107 on each of inventory boxes 105 desirably carry the same or an associative indicium 108. In this manner, inventory boxes 105 are coupled to signage 206. This effectively visually couples each display unit 100 with signage 206. It will appreciate that indicia 108 and 207 may be printed, screened, molded, engraved, or otherwise formed in any manner well known to those skilled in the art without departing from the spirit of the present invention.

In the preferred embodiments, mirror 208 is located between signage and the uppermost display unit 100. Mirror 208 serves as a selling tool by allowing a potential customer to view him/herself. Other mirrors 208 may be included as desired.

In summary, the present invention teaches a display system and unit for merchandising eyewear. Display unit 100 has a plurality of mounting options, presents eyewear 102 to a potential customer in an intuitive and easy to handle manner, displays eyewear 102 in a natural attitude, and provides customer access to a backup inventory.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A display unit for merchandising eyewear, said display unit comprising:
- a substantially horizontal and planar bottom panel;
- a substantially planar left panel coupled to said bottom panel;
- a substantially planar right panel coupled to said bottom panel; and
- a substantially planar top panel coupled between said left and right panels and oblique to said bottom panel, wherein said bottom, left, right, and top panels together encompass an interior space having a front opening and configured to house a plurality of inventory boxes accessible through said front opening.

2. A display unit as claimed in claim 1 additionally comprising a plurality of divider strips coupled to said top panel.

3. A display unit for merchandising eyewear, wherein:
- said display unit comprises:
  - a substantially horizontal and planar bottom panel;
  - a substantially planar left panel coupled to said bottom panel;
  - a substantially planar right panel coupled to said bottom panel;
  - a substantially planar top panel coupled between said left and right panels and oblique to said bottom panel; and
  - a plurality of divider strips coupled to said top panel;
- said top panel has a left top-panel edge, and a right top-panel edge;
- said left panel has a top left-panel edge;
- said right panel has a top right-panel edge;
- each of said divider strips has a top divider-strip edge and a bottom divider-strip edge;
- each of said bottom divider-strip edges is coupled to said top panel;
- said left top-panel edge is coupled to said left panel proximate said top left-panel edge so that each of said top divider-strip edges is substantially coincident with said top left-panel edge;
- said right top-panel edge is coupled to said right panel proximate said top right-panel edge so that each of said top divider-strip edges is substantially coincident with said top right-panel edge; and
- said bottom, left, right, and top panels together encompass an interior space having a front opening and configured to house a plurality of inventory boxes accessible through said front opening.

4. A display unit as claimed in claim 2 wherein said top panel and said divider strips are configured to support and display said eyewear.

5. A display unit as claimed in claim 1 additionally comprising a back panel coupled between said left panel and said right panel substantially perpendicular to said bottom panel.

6. A display unit as claimed in claim 5 wherein:

said back panel has a left back-panel mounting hole proximate said left panel and a predetermined distance above said bottom panel;

said back panel has a right back-panel mounting hole proximate said right panel and said predetermined distance above said bottom panel; and said right back-panel mounting hole is located an integral number of inches from said left back-panel mounting hole.

7. A display unit as claimed in claim 5 wherein:

said bottom panel, said left panel, and said right panel are formed of a first piece of material; and said top panel and said back panel are formed of a second piece of material.

8. A display unit as claimed in claim 5 wherein said back panel has a bottom back-panel edge displaced from said bottom panel.

9. A display unit as claimed in claim 1 wherein:

said top panel has a front top-panel edge substantially parallel to said bottom panel;

said top panel has a back top-panel edge substantially parallel to said bottom panel; and said front top-panel edge is closer to said bottom panel than said back top-panel edge.

10. A display unit as claimed claim 1 wherein:

said left panel has a back left-panel edge substantially perpendicular to a bottom left-panel edge; and said right panel has a back right-panel edge substantially perpendicular to a bottom right-panel edge.

11. A display unit as claimed in claim 1 wherein each of said plurality of inventory boxes is configured to contain an inventory of said eyewear.

12. A display system for merchandising eyewear comprising:

a left frame;

a right frame;

a plurality of display units, wherein each of said display units is coupled between and supported by said left frame and said right frame, and wherein each of said display units comprises:

a substantially horizontal and planar bottom panel;

a left panel substantially perpendicularly coupled to said bottom panel;

a right panel substantially perpendicularly coupled to said bottom panel; and a top panel coupled between said left panel and said right panel oblique to said bottom panel, wherein said bottom, left, right and top panels together encompass an interior space having a front opening and configured to house a plurality of inventory boxes accessible through said front opening.

13. A display system as claimed in claim 12 wherein said top panel of each of said display units comprises:

a front top-panel edge substantially parallel to said bottom panel; and a back top-panel edge substantially parallel to said bottom panel and closer to said bottom panel than said back top-panel edge.

14. A display system as claimed in claim 12 wherein each of said display units additionally comprises a plurality of divider strips coupled to said top panel.

15. A display system as claimed in claim 12 wherein:

said display system is configured to face in a predetermined direction; and each display unit in said plurality of display units is coupled between said left frame and said right frame so as to face in said predetermined direction.

16. A display system as claimed in claim 15 wherein said left frame and said right frame are substantially right trapezoids.

17. A display system as claimed in claim 12 wherein:

said display system is configured to face in each of a first predetermined direction and a second predetermined direction opposing said first predetermined direction;

each display unit in a first half of said plurality of display units is coupled between said left frame and said right frame so as to face in said first predetermined direction; and each display unit in a second half of said plurality of display units is coupled between said left frame and said right frame so as to face in said second predetermined direction.

18. A display system as claimed in claim 17 wherein said left frame and said right frame are substantially isosceles trapezoids.

19. A display system as claimed in claim 12 wherein:

each of said display units is configured to support and display a plurality of said eyewear;

each of said inventory boxes housed within said interior space and accessible through said front opening is configured to contain an inventory of said eyewear; and said display system additionally comprises:

signage coupled between said left frame and right frame above an uppermost one of said display units, wherein said signage includes an indicium of a brand name; and a label for each of said inventory boxes, wherein each of said labels includes and an indicium of said brand name.

20. A display system as claimed in claim 19 additionally comprising a mirror coupled between said left frame and said right frame between said signage and said uppermost display unit.

* * * * *